US005675123A

United States Patent [19]

Proctor et al.

[11] Patent Number: 5,675,123

[45] Date of Patent: Oct. 7, 1997

[54] CLAM-SHELL HOUSING HAVING RELEASABLY ATTACHABLE, WALL-MOUNTING MECHANISM

[75] Inventors: Richard L. Proctor, Seattle; George A. Ure, Kirkland; William L. Merkes, Seattle; Richard H. Young, Jr., Seattle; Steven H. Kahle, Seattle; Donald P. Aupperle, Seattle, all of Wash.

[73] Assignee: Cruising Equipment Company, Inc., Seattle, Wash.

[21] Appl. No.: 599,147

[22] Filed: Feb. 9, 1996

[51] Int. Cl.[6] ..... H01R 13/516

[52] U.S. Cl. ..... 174/58; 220/3.5; 220/4.02

[58] Field of Search ..... 174/50, 48, 58, 174/66, 17 CT; 220/3.8, 3.5, 3.6, 241, 3.92, 3.94, 4.02

[56] References Cited

U.S. PATENT DOCUMENTS

| | | | |
|---|---|---|---|
| 1,030,858 | 7/1912 | Ames | 220/3.6 |
| 2,297,862 | 10/1942 | Bachmann | 220/3.6 |
| 2,585,887 | 2/1952 | Woodward | 174/50 X |
| 2,605,012 | 7/1952 | Duncan | 220/3.6 |
| 2,842,281 | 7/1958 | Chisholm | 220/3.6 |
| 3,620,401 | 11/1971 | Lund | 220/3.6 |
| 3,710,972 | 1/1973 | Barry | 174/58 X |
| 4,163,137 | 7/1979 | Close, Jr. | 174/66 X |
| 4,438,995 | 3/1984 | Fisher et al. | 339/39 |
| 5,274,194 | 12/1993 | Belcher | 174/50 |
| 5,531,345 | 7/1996 | Nakamura et al. | 220/3.8 |

FOREIGN PATENT DOCUMENTS

| | | | |
|---|---|---|---|
| 2500295 | 7/1975 | Germany | 174/58 X |

OTHER PUBLICATIONS

IBM Technical Disclosure Bulletin, vol. 18, No. 6, Nov. 1975.

*Primary Examiner*—Hyung S. Sough
*Assistant Examiner*—Dean A. Reichard
*Attorney, Agent, or Firm*—Christensen O'Connor Johnson & Kindness PLLC

[57] ABSTRACT

The housing may be quickly and easily assembled in a clam-shell manner. The housing includes a pair of half-shells with each having a tongue for connecting to a face plate and a locking mechanism for connecting the half-shells together. The tongues are inserted into a pair of tongue-receiving fulcrum structures of the plate so that the half-shells are positioned in an open clam-shell arrangement. To complete the connection and the formation of the housing, the half-shells are rotated towards each other until the locking mechanism of one of the half-shells fastens to the locking mechanism of the other half-shell. Furthermore, the housing provides a wall-mounting mechanism for releasably attaching the housing to a wall, wherein that mechanism has two operative positions, including locking and release positions. In the locking position, the wall-mounting mechanism securely mounts the housing to the wall, and in the release position, the housing is unmounted and removable from the wall.

32 Claims, 4 Drawing Sheets

CLAM-SHELL HOUSING HAVING RELEASABLY ATTACHABLE, WALL-MOUNTING MECHANISM

TECHNICAL FIELD

This invention relates generally to housings for enclosing control or monitor electronic circuitry. More particularly, this invention relates to a housing which is removably mountable in a wall using a releasably attachable, wall-mounting mechanism. More particularly still, the present invention concerns such a housing that is assembled in a clam-shell fashion.

BACKGROUND ART

Rechargeable large-capacity batteries are commonly used in marine systems, alternative energy systems, recreational vehicle (RV) systems, industrial lift truck systems and electric vehicle systems. Since these systems depend upon battery power for operation, tracking the state-of-charge and other conditions of the battery is very useful. If the battery's charge is depleted without sufficient warning, a user may be stranded and unable to reach a power source to recharge the battery.

A battery monitor includes electronic components which preferably are housed inside of an enclosure. The enclosure contains and protects the components of the monitor. Typically, an enclosure includes openings that allow communication with external devices and/or with humans. These openings may provide access to buttons for input, to alphanumeric or graphics displays for output, and/or to an external device via a communications conduit for sending/receiving signals. Also, an enclosure is generally constructed of sturdy materials and may be securely attachable to some structure.

Of course, enclosures may house any form of electronics that may be unrelated to batteries, e.g., control electronics, system status monitor electronics, etc. Furthermore, enclosures may house items and devices other than electronics.

No known enclosure exists that may be quickly and easily assembled in a clam-shell manner. Furthermore, no known enclosure exists that may be mounted to a hole in a wall using a releasably attachable, wall-mounting mechanism for securely mounting the enclosure to the wall by capturing the wall between a plate and the mechanism, wherein the mechanism has two operative positions relative to the enclosure. The first position is a locking position in which the mechanism securely mounts the enclosure to the wall and the second position is a release position in which the enclosure is unmounted and removable from the wall.

DISCLOSURE OF THE INVENTION

The present invention is a clam-shell housing having a releasably attachable, wall-mounting ratchet ring. One objective of this invention is to overcome the drawbacks of existing housings and enclosures by providing parts and structures that allow for quick and easy assembly of a housing embodying the invention. To further overcome the drawbacks and to further another objective of this invention, an embodiment of this invention provides a wall-mounting mechanism for releasably attaching the housing to a wall, wherein that mechanism has two operative positions including a locking and a release position.

In accordance with one aspect of the present invention, a clam-shell housing assembly preferably includes a pair of half-shells, which form a cavity therebetween when connected together. Each of the half-shells has first and second attachment regions, with a tongue positioned in the first region and a locking mechanism in the second region. The locking mechanisms are configured to connect the half-shells together. The assembly further includes a face plate having a pair of tongue-receiving, fulcrum structures positioned so that each of the structures may receive and retain one of the tongues when the half-shells are connected. The half-shells and the plate are connected by placing one of the tongues into one of the structures and placing the other tongue into the other structure. At this point, the half-shells are positioned in an open clam-shell arrangement. To complete the connection and the formation of the housing, the half-shells are rotated towards each other, with each half-shell using one of the structures as a fulcrum to rotate about. They are rotated until the locking mechanism of one of the half-shells fastens to the locking mechanism of the other half-shell.

In accordance with another aspect of the present invention, a wall-mountable housing is designed to be mounted to a wall having a hole therethrough with the hole having a diameter. The housing preferably includes a face plate for positioning on one side of the wall and the plate has a maximum diameter greater than the diameter of the hole. The housing further includes a body for extending through the hole. The body is joined to the plate. For releasably attaching the body to the wall, the housing further includes a wall-mounting mechanism for positioning on the other side of the wall and for securely mounting the body to the wall by capturing the wall between the plate and the wall-mounting mechanism. The wall-mounting mechanism preferably has two operative positions relative to the body. Those positions including a locking position and a release position. In the locking position, the wall-mounting mechanism securely mounts the body to the wall, and in the release position, the body is unmounted and removable from the wall.

These and other objects and advantages of the present invention will be more readily understood after a consideration of the drawings and the detailed description of the preferred embodiment which follows.

DETAILED DESCRIPTION OF THE PREFERRED EMBODIMENT AND BEST MODE FOR CARRYING OUT THE INVENTION

Figure 1:
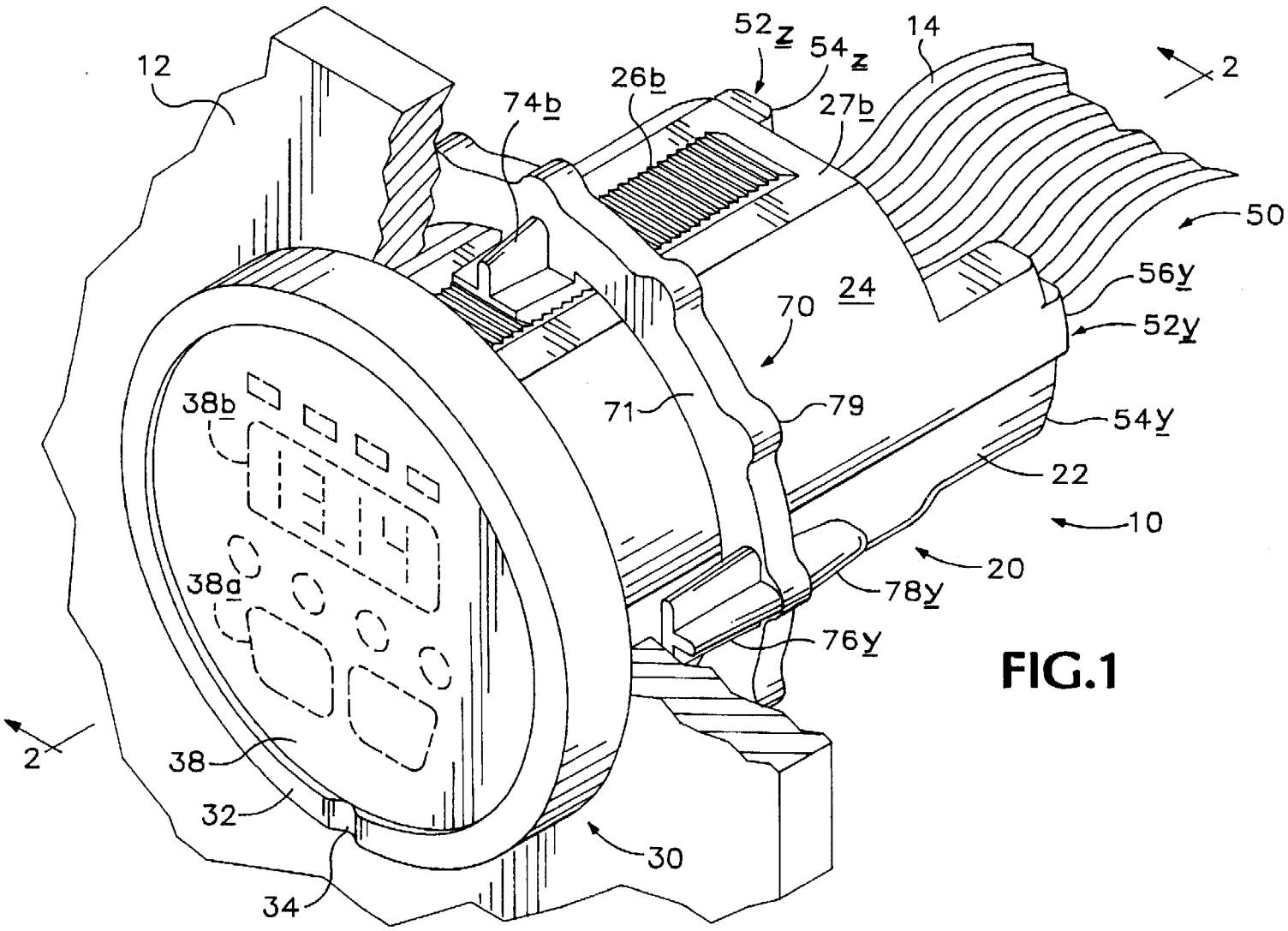
FIG. 1 is an isometric view of a housing, constructed in accordance with a preferred embodiment of the invention, in which the housing is mounted in a wall which is cut away to show the structure of the housing.

FIGS. 1–4 show a preferred embodiment 10 of the present invention which is an enclosure or housing for internal electronics of a battery state-of-charge monitor. In its preferred embodiment, housing 10 is mounted into a hole 16 (see FIG. 2) of a wall 12. That wall may be a bulkhead of a marine vehicle, a dashboard of an electronic vehicle, or any panel having a thickness less than the depth of the housing. Wall 12 of FIG. 1 is fragmented to show the structure of housing 10.

In its preferred embodiment, the housing holds internal electronics 48 (see FIG. 2) designed to monitor the status of a battery-powered system. Those electronics are connected to one or more external devices, such as an ammeter, via a communications conduit 14. Such a communication conduit permits the routing of signals, as through one or more conductors, e.g., a conduit may contain one or more cables, such as a ribbon cable. Although not shown, the preferred embodiment invention also includes a nine-pin D-shell serial connector. Using this connector, the internal electronics in the housing may communicate with an external device, such as a personal computer, via a serial cable. The housing includes a body or casing 20.

The body is formed by first and second half-shells 22, 24. The half-shells are connected to a face plate 30 to form a substantially hollow cavity 18 (see FIG. 2) within. Body 20 has a generally cylindrical shape formed by the two half-shells. Each half-shell has a generally semi-cylindrical shape, wherein such a shape is formed by bisecting a cylinder so that the plane of the bisection includes the longitudinal axis of the cylinder. As shown in FIG. 4, first half-shell 22 has a seam structure 23*a* and second half-shell 24 has a seam structure 23*b*. When the two half-shells are connected, these seam structures form a seam 23 as shown in FIGS. 2 and 3.

In the preferred embodiment of the invention, each of the half-shells are preferably substantially interchangeable and more preferably substantially identical. The half-shells are interchangeable because first half-shell 22 may replace second half-shell 24 and vice versa. Since the half-shells are interchangeable, the assembly of housing 10 is substantially easier because the assembler need not be concerned about the orientation or selection of any particular half-shell. The assembler needs only to use any two half-shells and a plate 30 to assemble the housing. Furthermore, the manufacturer only needs to produce one half-shell because each half-shell is substantially identical. Moreover, in the preferred embodiment, the half-shells are preferably elongate and the housing is more preferably symmetrical about its longitudinal axis.

Figure 2:
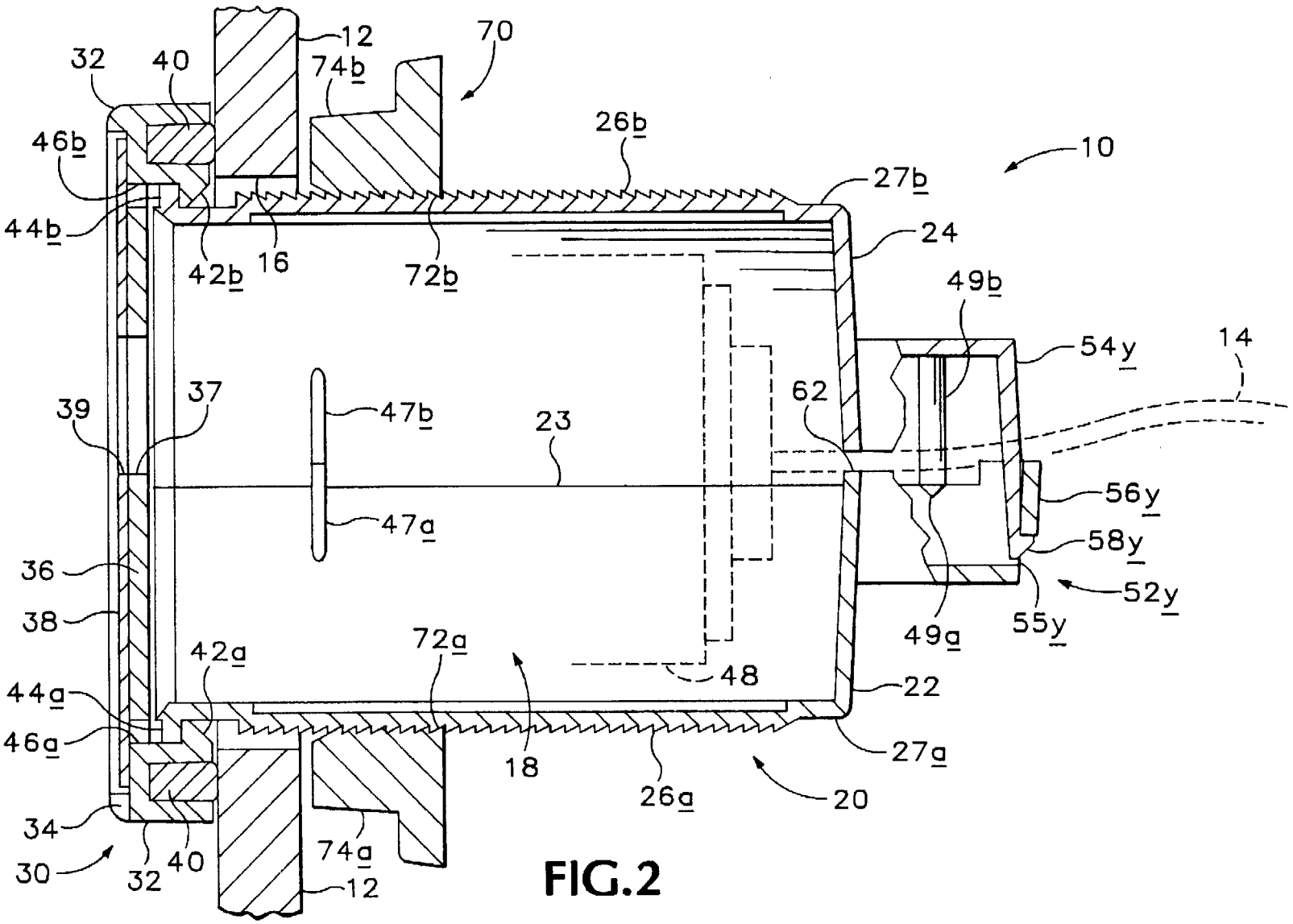
FIG. 2 is a partially fragmentary, cross-sectional view of the housing of FIG. 1 taken along line 2—2 of FIG. 1.
Figure 3:
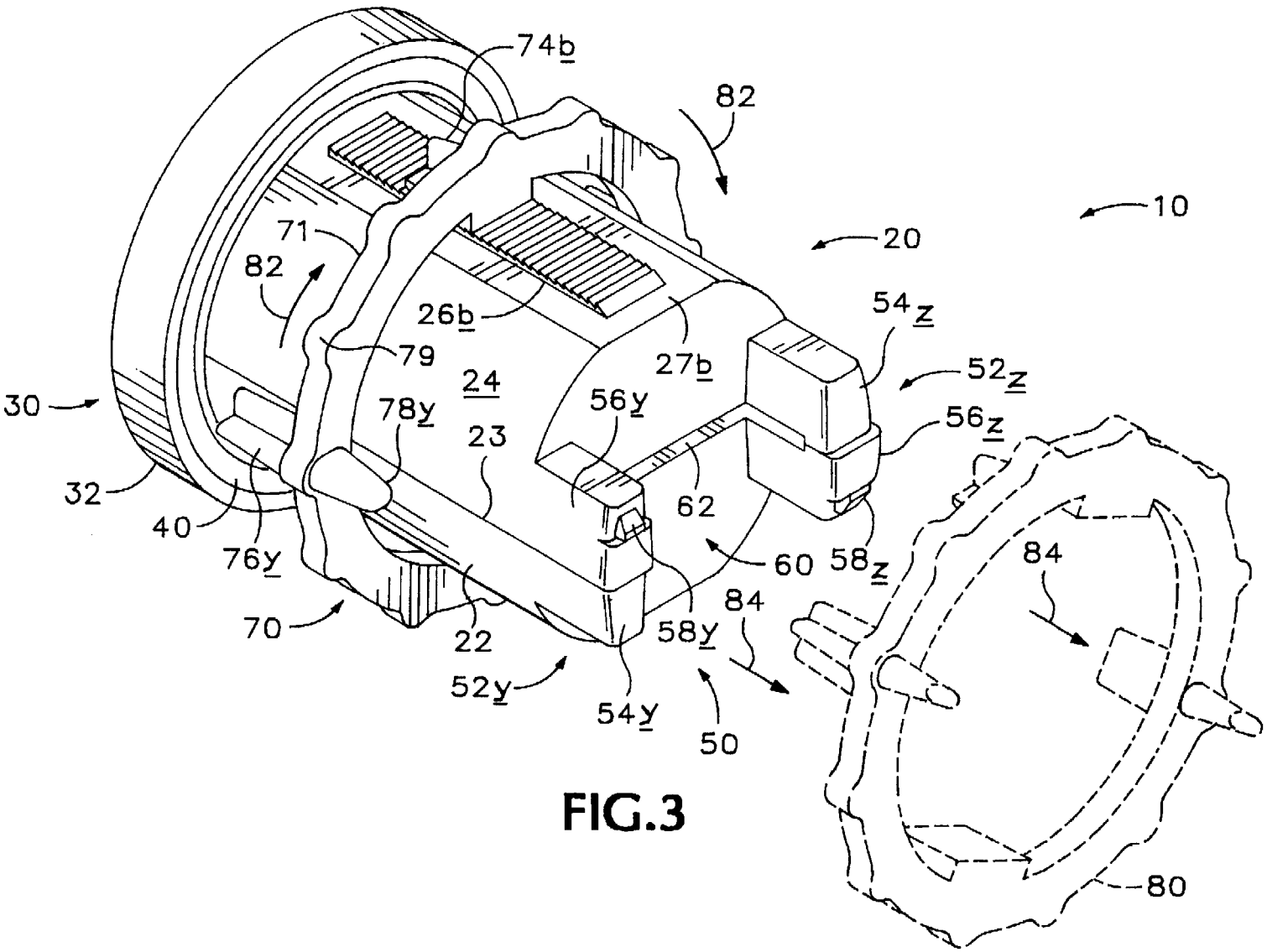
FIG. 3 is an isometric view of the housing of FIG. 1 from the rear of the housing without the wall and with a released ratchet ring shown in phantom lines.
Figure 4:
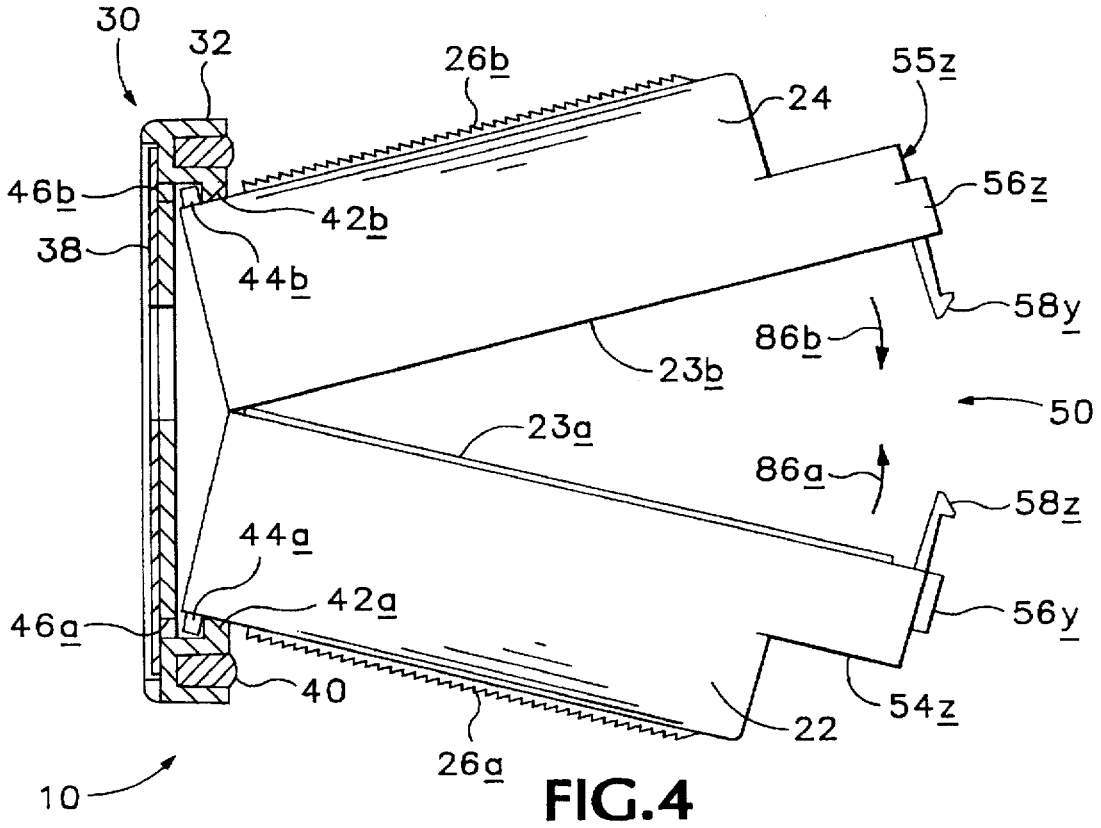
FIG. 4 is a partially cross-sectional, side elevation view of the housing of FIG. 1 with only a face plate shown in cross section along line 2—2 of FIG. 1.

As shown in FIGS. 1 through 4, second half-shell 24 has a substantially planer outer surface 27*b* on which a strip 26*b* of ratchet teeth are joined. In the preferred embodiment, the strip is elongate and extends substantially from the rear of the housing to the front of the housing, the rear of the housing being the one that is nearer to rear section 50 and the front of the housing being nearer to face plate 30. In the preferred embodiment, the strip is formed integrally with the remainder of the half-shell, although it will be understood that any suitable method, including an assembly of piece parts, may be used to form the strips and the half-shells. The teeth of ratchet strip 26*b* are substantially equally spaced from each other and each tooth has a generally inclined plane wherein the slope of the inclined plane of each tooth is substantially the same. As shown in FIG. 2, first half-shell 22 has a similar planar outer surface 27*a* with a similar strip 26*a* of ratchet teeth joined thereto by any suitable means.

When the housing is assembled, body 20 is connected to face plate 30. As shown in FIGS. 1 and 2, plate 30 is generally circular disk-shaped and has a generally annular support flange and rim 32 defining the periphery of the plate. Preferably integrally joined to support flange and rim 32 is support expanse 36. Covering the support expanse is front panel insert 38. Since the internal electronics may include output devices such as an LCD display or some other visible indicator, and input devices, such as buttons, support expanse 36 preferably has an opening 37 therein and front panel insert 38 preferably has a corresponding opening 39. FIG. 1 shows in phantom lines buttons and other indicating indicia 38*a* and an LCD or LED 38*b*.

As shown in FIGS. 2 through 4, a gasket 40 is fitted into a channel 33 formed in a rear annular expanse of the plate's flange 32, the gasket being preferably formed from elastomeric material so that it may deform to form a watertight seal against the wall. As shown in FIGS. 1 and 2, flange and rim 32 of plate 30 preferably includes a notch 34 which allows drainage of water gathered on insert 38 when the notch is oriented downstream of water drainage flow. This is particularly advantageous when the housing is used in a marine environment or outdoors.

The reference designators used herein and in FIGS. 1–6 may include alphabetic subdesignators which indicate the orientation of the depicted structure. Accordingly, the letter "a" refers to structure which is below seam 23 and the letter "b" refers to structures which are above seam 23. For other structures, the letter "y" refers to structures on the right side of the housing and "z" on the left side of the housing, when the housing is viewed from the front, as in FIG. 1.

As shown in FIGS. 2 and 4, each of half-shells 22, 24 of body 20 includes a tongue 44*a*, 44*b* in a first attachment region, which preferably is the region of the body adjacent face plate 30. Each tongue is preferable in the form of a generally rectangular protrusion having approximately 1/16 inch width and an approximately 5/16 inch length. Plate 30 includes two tongue-receiving fulcrum structures 42*a*, 42*b*. Each of the tongue-receiving fulcrum structures is designed to receive one of the tongues of a half-shell. Each structure preferably form-fittingly receives a tongue. The half-shells are connected to the plate by placing tongue 44*a* into structure 42*a* and placing tongue 44*b* into structure 42*b* so that the arrangement of the half-shells is similar to that of an open clam shell (see FIG. 4). The fulcrum structures by their longitudinal dimensions may form gaps 46*a* and 46*b* or spaces adjacent plate 30 which allow the tongues to be inserted and rotated without interference. To complete the connection of the half-shells from the open clam shell arrangement, the half-shells are rotated toward each other as indicated by arrows 86*b* and 86*a* of FIG. 4, with each half-shell using one of the structures of the fulcrum to rotate about until the half-shells fasten together.

As shown in FIG. 2, the half-shells may include internal support structures such as 47*a*, 47*b*, 49*a*, 49*b*, which facilitate and promote connection of the half-shells. In general, these structures may facilitate alignment of the half-shells during connection, may hold internal components, and may resist lateral motion of the half-shells relative each other. In particular, front internal support structures 47*a*, 47*b* is shown in the cross section of body 20 in FIG. 5. Lower front structure 47*a* is an elongate post projected upward from the interior wall of first half-shell 22. Structure 47*a* will substantially resist translational lateral movement of the half-shells relative to each other. It extends past seam 23. Upper front structure 47*b* is a shorter elongate post projected downward from the interior wall of second half-shell 24. The longitudinal axes of each of structures 47*a*, 47*b* is co-linear. Rear internal support structures 49*a*, 49*b* are described below.

Internal electronics 48 are partially shown in FIG. 2 in phantom lines and communications conduit 14 is shown through communications orifice 62 for connection to external devices. Orifice 62 preferably is a slotted hole positioned between latch structures 52*y*, 52*z* (described below) so that the latch structures do not interfere with the communications orifice.

FIGS. 1–4 show latch structures 52*y*, 52*z* in the second attachment region of body 20, that region being generally labeled rear section 50 in FIGS. 1, 3 and 4. The latch structures securely attach the half-shells to each other. Each half-shell includes a locking mechanism that includes portions of the latch structures. In the preferred embodiment, the locking mechanism of each half-shell includes a locking tab and a tab-receiving station. The station is configured to receive and retain such a locking tab. With regard to first half-shell 22, the locking mechanism includes elongate locking tab 58*z* (see FIGS. 3 and 4) and tab-receiving station 56*y* (see FIGS. 2–4). With regard to second half-shell 24, the locking mechanism includes elongate locking tab 58*y* (see FIGS. 2–4) and tab-receiving station 56*z* (see FIGS. 1, 3 and 4). The locking mechanisms of the half-shells are configured to connect the half-shells together by fastening tab 58*y* of second half-shell 24 to station 56*y* of first half-shell 22 and fastening tab 58*z* of the first half-shell to station 56*z* of the second half-shell.

Once connected together, the locking mechanisms of the half-shells form right and left latch structure 52*y*, 52*z*. FIG. 2 shows a fragmentary and cross-sectional portion of right latch structure 52*y*. In the preferred embodiment, the following elements are integrally formed parts of second half-shell 24: tab base 54*y*, elongate and projecting locking tab 58*y*, rear internal support structure 49*b* and tapered extension 49*a* of the rear internal support structure. Tab base 54*y* connects the tab to the remainder of the half-shell. Tab 58*y* extends from base 54*y* (as shown in FIG. 2) and is biased so as to resist removal when captured by a station. Tab 58*y* further includes a catch that is configured to allow insertion into a station and resist removal from a station. Upper rear internal support structure 49*b* is attached to an interior wall of second half-shell 24 and provides additional structural support. When the half-shells are connected, tapered extension 49*a* of the rear internal support structure is designed to extend into the first half-shell. The extension provides additional structural support to resist separation of the half-shells caused by torsional or lateral forces.

In the preferred embodiment, the following structures are an integrally formed part of first half-shell 22: tab-receiving station 56*y* and station orifice 55*y*. The station is configured to allow substantially easy insertion of tab 58*y* so that its catch is captured in orifice 55*y*. The bias of tab 58*y* keeps the catch in the orifice. To separate connected half-shells, the catch of tab 58*y* must be removed from orifice 55*y*. This may be accomplished by pressing a pen or a screwdriver against the exposed catch of tab 58*y* until it is no longer held in the orifice.

Left latch structure 52*z* functions in a substantially identical manner and includes substantially identical structures as right latch structure 52*y*. Left latch structure 52*z* is effectively the mirror image of right latch structure 52*y* with the bisecting plane of the reflection being along seam 23. As shown in FIGS. 1, 3 and 4, first half-shell 22 preferably includes the following integrally formed parts of left latch structure: tab base 54*z*; elongate, projecting and biased locking tab 58*z* (see FIGS. 3 and 4); a rear internal support structure (not shown but similar to 49*b*) and a tapered extension (not shown but similar to 49*a*) of the rear internal support structure. As shown in FIGS. 1, 3 and 4, second half-shell 24 preferably includes the following integrally formed parts of left latch structure: tab-receiving station 56*z* and station orifice 55*z* (see FIG. 4).

As shown in FIGS. 1–3, 5 and 6, housing 10 includes a wall-mounting mechanism 70. The wall-mounting mechanism is for releasably attaching body 20 to wall 12. As shown in FIG. 1, plate 30 on one side of the wall is connected to body 20. The body extends through hole 16 in the wall. Wall-mounting mechanism 70 is positioned on the other side of the wall and is connected to the body. The wall-mounting mechanism securely mounts the body to the wall by capturing the wall between the plate and the wall-mounting mechanism.

Wall-mounting mechanism 70 has at least two operative positions relative to body 20. Those positions including a locking position and a release position. FIGS. 1–3 and 5 illustrate examples of wall-mounting mechanism 70 in the locking position. In that position, the wall-mounting mechanism securely mounts the body to the wall. In the release position, the body is unmounted and removable from the wall. FIG. 3 shows in a phantom line-depicted mechanism 80 in a release position. In the release position, the wall-mounting mechanism is no longer connected to the body.

Figure 5:
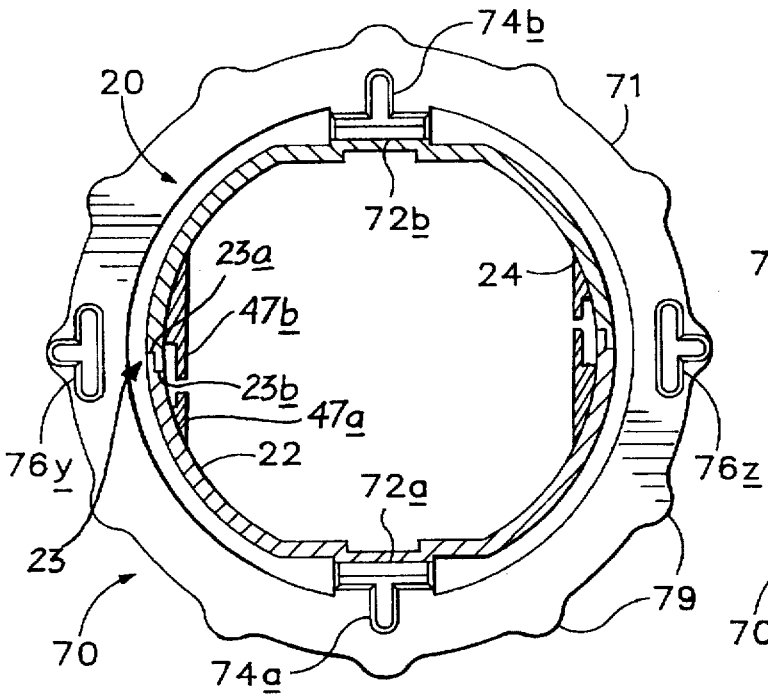
FIG. 5 is a partially cross-sectional, front elevation view of the housing of FIG. 1 with only a body of the housing shown in cross section.

FIG. 5 shows a front elevation view of wall-mounting mechanism 70 and a transverse cross section of body 20. The cross section of body 20 illustrates the body's transverse cross-sectional shape which represents its maximum, transverse cross-sectional diameter. The cross section is taken through front internal support structures 47*a*, 47*b*. The cross section also shows configuration of seal 23, the seal including seal structures 23*a*, 23*b*. FIG. 5 does not show any background structures. The wall-mounting mechanism includes a generally annular ratchet ring 71 that substantially conforms to the cross-sectional shape of the body and has greater diameter than the maximum diameter of the body.

As shown in FIGS. 1–3 and 5, annular ratchet ring 71 is configured to fit around the generally cylindrical body. As shown in FIG. 3 and indicated by arrows 82, the ring may rotate about a longitudinal axis of the cylindrical body. A person may twist the ring to transfer the wall-mounting mechanism quickly from the locking position to the release position. The wall-mounting mechanism is placed in the locking position by translational movement of ring 71 toward the wall and, from there, the wall-mounting mechanism may be moved to the release position by rotating the ring about the longitudinal axis of the cylindrical body in a direction of arrows 82 (see FIG. 3).

Preferably, ring 71 includes grip-enhancing structures that facilitate gripping of the ring by a human hand so that the ring may be rotated about the body as indicated by arrows 82 (see FIG. 3) and removed from the body as indicated by arrows 84 (see FIG. 3). The gripping-enhancing structures includes an annular edge having a plurality of scallops 79 thereon and finger protrusions 78*y*, 78*z* (see FIG. 3). The wall-mounting mechanism preferably includes abutment protrusions 76*y*, 76*z* extending from the ring. The abutment protrusions are designed to contact the wall when the wall-mounting mechanism is in the locking position.

Figure 6:
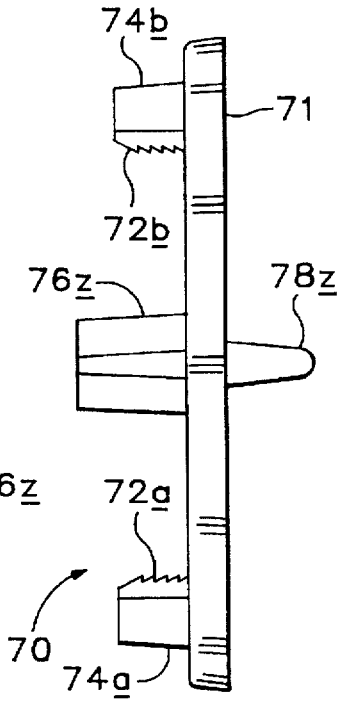
FIG. 6 is a side elevation view of the ratchet ring alone.

In the preferred embodiment of the invention, wall-mounting mechanism 70 includes strips 26*a*, 26*b* of ratchet teeth and ring 71. As shown in FIGS. 2, 5 and 6, the ring has a pair of ratchet members 74*a*, 74*b* with ratchet teeth 72*a*, 72*b* that are configured to engage the teeth of the strips. The ring is configured to fit around body 20 so that the teeth of members 74*a*, 74*b* and strips 26*a*, 26*b* may engage each other. The engagement of the teeth of the members and strips substantially inhibits removal of the ring from the body by substantially resisting translational movement of the ring away from wall 12 while substantially allowing translational movement of the ring toward the wall. Furthermore, engagement of the teeth of the members and strips does not substantially resist rotation of ring 71 about a longitudinal axis of cylindrical body 20.

In the preferred embodiment of the invention, face plate 30 is preferably integrally molded from thirty-percent glass-filled NYLON® 6/6 synthetic material or another suitable material. Each of the half-shells is preferably integrally molded from a similar material. Such a half-shell preferably includes the following integrally joined elements: the strips of ratchet teeth, the locking mechanism, the internal support structures and the tongue. The ratchet ring is preferably integrally molded from twenty-percent glass-filled NYLON® 6/6 synthetic material or another suitable material.

In the preferred embodiment, the housing has an overall depth of approximately 2.9 inches. The face plate preferably has a width of approximately 2.5 inches and the body preferably has a width of approximately 1.95 inches. The housing preferably mounts in a hole which is between 1.95 and 2.5 inches in diameter. Of course, the dimensions of the housing may be adjusted to accommodate internal components.

INDUSTRIAL APPLICABILITY

While the present invention is particularly useful for housing electronics and circuitry, it may also be useful for materials or devices. The housing is particularly useful when mounting the housing to a wall (or other structure). Furthermore, the present invention is useful in the quick and efficient manufacture and assembly of such housings.

While the preferred embodiment and best mode of the invention have been disclosed, variations and changes may be made without departing from the spirit and scope of the invention.

We claim:

1. A clam-shell housing assembly comprising:

a pair of half-shells, which form a cavity therebetween when connected together, each of said half-shells including first and second attachment regions, a tongue positioned in the first region, and a locking mechanism in the second region, wherein said locking mechanisms of said half-shells are configured to connect said half-shells together, and a face plate including a pair of tongue-receiving fulcrum structures positioned so that each of said structures may receive and retain one of said tongues when said half-shells are connected, wherein connection of said half-shells and said plate is accomplished by placing one of said tongues into one of said structures and placing another of said tongues into another of said structures, thereby producing an open clam shell arrangement of said half-shells; and rotating said half-shells towards each other, with each half-shell using one of said structures as a fulcrum to rotate about, until said locking mechanism of one of said half-shells fastens to said locking mechanism of the other of said half-shells.

2. The housing assembly of claim 1, wherein said locking mechanism of each of said half-shells includes a locking tab and a tab-receiving station, which is configured to receive and retain such a locking tab, wherein said locking mechanisms of said half-shells are configured to connect said half-shells together by fastening said tab of one of said half-shells to said station of the other of said half-shells and fastening said tab of that other to said station of that one.

3. The housing assembly of claim 2 for containing internal electronics having a communications system for transmitting to or receiving signals from at least one external device via a communication conduit, wherein, said half-shells, when connected, include an orifice positioned between said tab and said station of each of said half-shells, said orifice providing a passageway for such a conduit so that the internal electronics may operatively communicate with at least one external device.

4. The housing assembly of claim 1 for containing internal electronics having a communications system for transmitting to or receiving signals from at least one external device via a communications conduit, wherein one or both of said half-shells includes an orifice located in the second region, said orifice providing a passageway for such a conduit so that the internal electronics may operatively communicate with at least one external device.

5. The housing assembly of claim 1, wherein said plate has a raised rim about its periphery, said rim having a notch which facilitates drainage of water gathered on said plate when said notch is oriented downstream of water drainage flow.

6. The housing assembly of claim 1, wherein said half-shells are interchangeable.

7. The housing assembly of claim 1, wherein said half-shells are identical.

8. The housing assembly of claim 1, wherein said half-shells are elongate so that, when said plate and half-shells are connected, the housing assembly is symmetrical about its longitudinal axis.

9. A method of assembling a clam-shell housing, wherein the housing includes a pair of half-shells, which form a cavity therebetween when connected together, each of the half-shells including first and second attachment regions, a tongue positioned in the first region, and a locking mechanism in the second region, wherein the locking mechanisms of the half-shells are configured to connect the half-shells together, and a face plate including a pair of tongue-receiving fulcrum structures positioned so that each of the structures may receive and retain one of the tongues when the half-shells are connected, the method comprising:

positioning the tongue of one of the half-shells into one of the structures of the plate and positioning the tongue of the other half-shell into the other structure, thereby producing an open clam shell arrangement of the half-shells;

rotating the half-shells towards each other, with each of the half-shells using one of the structures as a fulcrum to rotate about, so that the locking mechanisms of the half-shells approach each other; and fastening together the locking mechanisms of the half-shells, thereby forming a substantially closed cavity within the half-shells and the plate.

10. A wall-mountable housing for mounting to a wall having a hole therethrough with the hole having a diameter, the housing comprising:

a face plate for positioning on one side of the wall, said plate having a maximum diameter greater than the diameter of the hole;

a body for extending through the hole and joined to said plate; and a releasably attachable, wall-mounting mechanism for positioning on another side of the wall and for securely mounting said body to the wall by capturing the wall between said plate and said wall-mounting mechanism, wherein said wall-mounting mechanism has two operative positions relative to said body, said positions including a locking position in which said wall-mounting mechanism securely mounts said body to the wall and a release position in which said body is unmounted and removable from the wall.

11. The housing of claim 10, wherein said body has a transverse cross-sectional shape representing a maximum, transverse cross-sectional diameter of said body and said wall-mounting mechanism includes a ring that substantially conforms to the cross-sectional shape of said body and has greater diameter than the maximum, transverse cross-sectional diameter of said body.

12. The housing of claim 10, wherein said body is generally cylindrical and said wall-mounting mechanism includes a generally annular ring, and wherein said ring is configured to fit around said cylindrical body so that said ring may rotate about a longitudinal axis of said cylindrical body.

13. The housing of claim 12, wherein rotation of said ring transfers said wall-mounting mechanism from the locking position to the release position.

14. The housing of claim 12, wherein said ring includes grip-enhancing structures that facilitate gripping of said ring by a human hand so that said ring may be rotated about said body.

15. The housing of claim 12, wherein said ring includes a scalloped annular edge to facilitate gripping of said ring.

16. The housing of claim 12, wherein said ring includes protrusions to facilitate gripping of said ring.

17. The housing of claim 12, wherein said wall-mounting mechanism further includes abutment protrusions for contacting the wall when said wall-mounting mechanism is in the locking position.

18. The housing of claim 10, wherein said body is generally cylindrical and said wall-mounting mechanism includes a generally annular ring, and wherein said ring is placed in the locking position by translational movement toward said wall and, from there, said ring is placed in the release position by rotation of said ring about a longitudinal axis of said cylindrical body.

19. The housing of claim 10, wherein said wall-mounting mechanism includes:

a strip of ratchet teeth joined to said body, and a ratchet ring having a ratchet member with ratchet teeth, said ring being configured to fit around said body so that said teeth of said member and strip may engage each other, wherein engagement of said teeth of said member and strip inhibits removal of said ring from said body by resisting translational movement of said ring away from the wall while allowing translational movement of said ring toward the wall.

20. The housing of claim 10, wherein said body is generally cylindrical and said wall-mounting mechanism includes a strip of ratchet teeth joined to said body and a generally annular ratchet ring having a ratchet member with ratchet teeth, said ring being configured to fit around said body so that said teeth of said member and strip may engage each other, wherein engagement of said teeth of said member and strip inhibits removal of said ring from said body by resisting translational movement of said ring away from the wall while allowing translational movement of said ring toward the wall and wherein engagement of said teeth of said member and strip does not resist rotational movement of said ring about a longitudinal axis of said body.

21. The housing of claim 10, wherein said plate includes an annular flange for holding an annular gasket on a wall-facing side of said plate, said gasket being deformable so that said gasket may produce a water-tight seal against the wall and about the hole, wherein locking said wall-mounting mechanism tightly against the wall deforms said gasket.

22. A wall-mountable, clam-shell housing for mounting to a wall having a hole therethrough with the hole having a diameter, the housing comprising:

a body for extending through the hole, said body including a pair of half-shells, which form a cavity therebetween when connected together, each of said half-shells including first and second attachment regions, a tongue positioned in the first region, and a locking mechanism in the second region, wherein said locking mechanisms of said half-shells are configured to connect said half-shells together;

a face plate for positioning on one side of the wall, said plate having a maximum diameter greater than the diameter of the hole, said plate including a pair tongue-receiving fulcrum structures that join said plate to said body, said fulcrum structures being positioned so that each of said structures may receive and retain one of said tongues when said half-shells are connected, wherein connection of said half-shells and said plate is accomplished by placing one of said tongues into one of said structures and placing another of said tongues into another of said structures, thereby producing an open clam shell arrangement of said half-shells; and rotating said half-shells towards each other, with each half-shell using one of said structures as a fulcrum to rotate about, until said locking mechanism of one of said half-shells fastens to said locking mechanism of the other of said half-shells; and a releasably attachable, wall-mounting mechanism for positioning on another side of the wall and for securely mounting said body to the wall by capturing the wall between said plate and said wall-mounting mechanism, wherein said wall-mounting mechanism has two operative positions relative to said body, said positions including a locking position in which said wall-mounting mechanism securely mounts said body to the wall and a release position in which said body is unmounted and removable from the wall.

23. The housing of claim 22, wherein said body has a transverse cross-sectional shape representing a maximum transverse cross-sectional diameter of said body and said wall-mounting mechanism includes a ring that substantially conforms to the cross-sectional shape of said body and has greater diameter than the maximum transverse cross-sectional diameter of said body.

24. The housing of claim 22, wherein said body is generally cylindrical and said wall-mounting mechanism includes a generally annular ring, and wherein said ring is configured to fit around said cylindrical body so that said ring may rotate about a longitudinal axis of said cylindrical body.

25. The housing of claim 24, wherein rotation of said ring transfers said wall-mounting mechanism from the locking position to the release position.

26. The housing of claim 22, wherein said body is generally cylindrical and said wall-mounting mechanism includes a generally annular ring, and wherein said ring is placed in the locking position by translational movement toward said wall and, from there, said ring is placed in the release position by rotation of said ring about a longitudinal axis of said cylindrical body.

27. The housing of claim 22, wherein said wall-mounting mechanism includes:

a strip of ratchet teeth joined to said body, and a rachet ring having a ratchet member with ratchet teeth, said ring being configured to fit around said body so that said teeth of said member and strip may engage each other, wherein engagement of said teeth of said member and strip inhibits removal of said ring from said body by resisting translational movement of said ring away from the wall while allowing translational movement of said ring toward the wall.

28. The housing of claim 22, wherein said body is generally cylindrical and said wall-mounting mechanism includes a generally annular ring, and said wall-mounting mechanism includes a strip of ratchet teeth joined to said body, and a rachet ring having a ratchet member with ratchet teeth, said ring being configured to fit around said body so that said teeth of said member and strip may engage each other, wherein engagement of said teeth of said member and strip inhibits removal of said ring from said body by resisting translational movement of said ring away from the wall while allowing translational movement of said ring toward the wall and wherein engagement of said teeth of said member and strip does not resist rotational movement of said ring about a longitudinal axis of said cylindrical body.

29. The housing of claim 22, wherein said locking mechanism of each of said half-shells includes a locking tab and a tab-receiving station, which is configured to receive and retain such a locking tab, wherein said locking mechanisms of said half-shells are configured to connect said half-shells together by fastening said tab of one of said half-shells to said station of the other of said half-shells and fastening said tab of that other to said station of that one.

30. The housing of claim 29 for containing internal electronics having a communications system for transmitting to or receiving signals from at least one external device via a communications conduit, wherein, said half-shells, when connected, include an orifice positioned between said tab and said station of each of said half-shells, said orifice providing a passageway for such a conduit so that the internal electronics may operatively communicate with at least one external device.

31. The housing of claim 22 for containing internal electronics having a communications system for transmitting to or receiving signals from at least one external device via a communications conduit, wherein one or both of said half-shells includes an orifice located in the second region, said orifice providing a passageway for such a conduit so that the internal electronics may operatively communicate with at least one external device.

32. The housing of claim 22, wherein said plate has a raised rim about its periphery, said rim having a notch which facilitates drainage of water gathered on said plate when said notch is oriented downstream of water drainage flow.

* * * * *